US006938521B1

(12) United States Patent
Skeens

(10) Patent No.: US 6,938,521 B1
(45) Date of Patent: Sep. 6, 2005

(54) ELONGATED RATCHET HANDLE

(76) Inventor: Timmy L. Skeens, 900 E. North "H" St., Gas City, IN (US) 46933

( * ) Notice: Subject to any disclaimer, the term of this patent is extended or adjusted under 35 U.S.C. 154(b) by 0 days.

(21) Appl. No.: 10/680,007

(22) Filed: Oct. 7, 2003

(51) Int. Cl.[7] ..... B25B 13/46
(52) U.S. Cl. ..... 81/60; 81/177.2; 81/177.5
(58) Field of Search ..... 81/58, 60, 61, 81/62, 63, 63.1, 177.5, 177.2, 124.7, 177.85

(56) References Cited

U.S. PATENT DOCUMENTS 1,578,114 A * 3/1926 Fegley ..... 81/124.6
4,926,721 A 5/1990 Hsiao
5,392,672 A * 2/1995 Larson et al. ..... 81/60
5,461,950 A 10/1995 Iwinski
D386,955 S 12/1997 Jones et al.
5,713,252 A 2/1998 Iwinski et al.
5,797,300 A * 8/1998 Fairbanks ..... 81/60
6,138,531 A 10/2000 Lamons
6,240,809 B1 * 6/2001 Sasarak ..... 81/60
6,263,766 B1 7/2001 Jarvis
6,378,400 B1 4/2002 Bogli
D462,246 S 9/2002 Skeens

* cited by examiner

*Primary Examiner*—Jacob K. Ackun, Jr.
(74) *Attorney, Agent, or Firm*—Krieg DeVault LLP

(57) ABSTRACT

The inventions disclosed an elongated ratchet handle suitable for accepting detachable arm extensions. A ratchet mechanism is secured within an elongated body. The ratchet mechanism has an actuator movably positioned on its top side and a drive post depending from its bottom side. Opposite ends of the body may extend outwardly and upwardly for a centrally located bore. Extension arms can be releasably connected to the opposite ends.

22 Claims, 6 Drawing Sheets

ELONGATED RATCHET HANDLE

DETAILED DESCRIPTION OF SPECIFIC EMBODIMENTS

Figure 1:
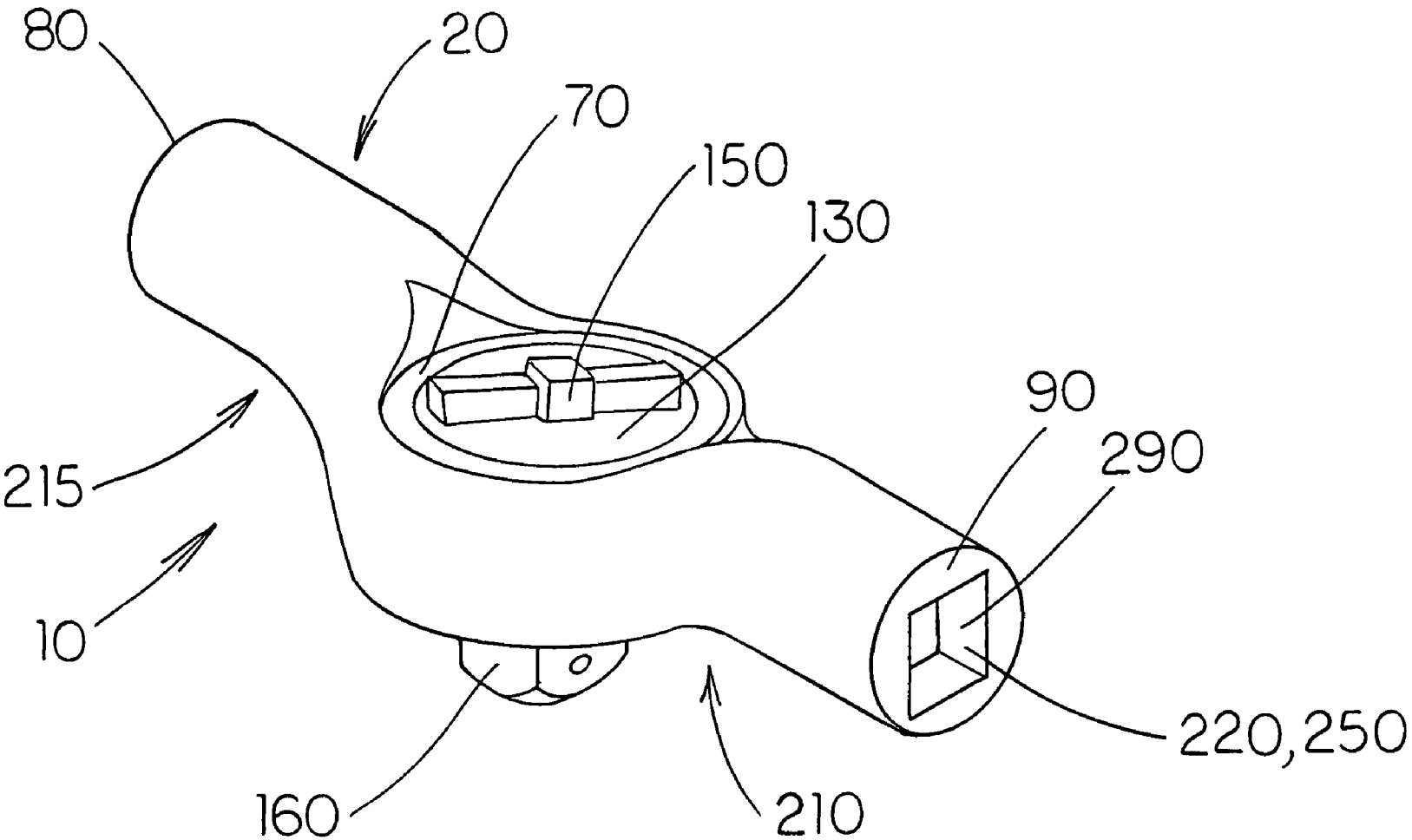
FIG. 1 shows a perspective view of the elongated ratchet handle including the ratchet mechanism.

Referring to FIG. 1, an elongated ratchet 10 handle comprising an elongated body 20 having a top 30, a bottom 40, a side 50, a centrally located step diametered bore 60 extending from the top 30 through the bottom 40 and an annular step 70 surrounding the step diametered bore 60 substantially at the top 30 is shown. Opposite ends 80, 90 of the elongated body 20 have extension arm connectors 100, 110. A ratchet mechanism 120 having a top surface 130 and a bottom surface 140 is secured in the step diametered bore 60. The ratchet mechanism 120 has an actuator 150 being movably positioned on the top surface 130 and a drive post 160 depending from the bottom surface 140.

In one version of the invention, opposite ends 80, 90 extend upwardly and outwardly away from the step diametered bore 60 thereby defining finger spaces 210, 215 between the elongated body 20 and a work piece. The finger spaces 210, 215 allow the user to grip the elongated body 20 in the palm of the hand and the fingers between the body 20 and the work piece to exert force moments on the elongated body 20 without the work piece engaging the fingers.

Figure 2:
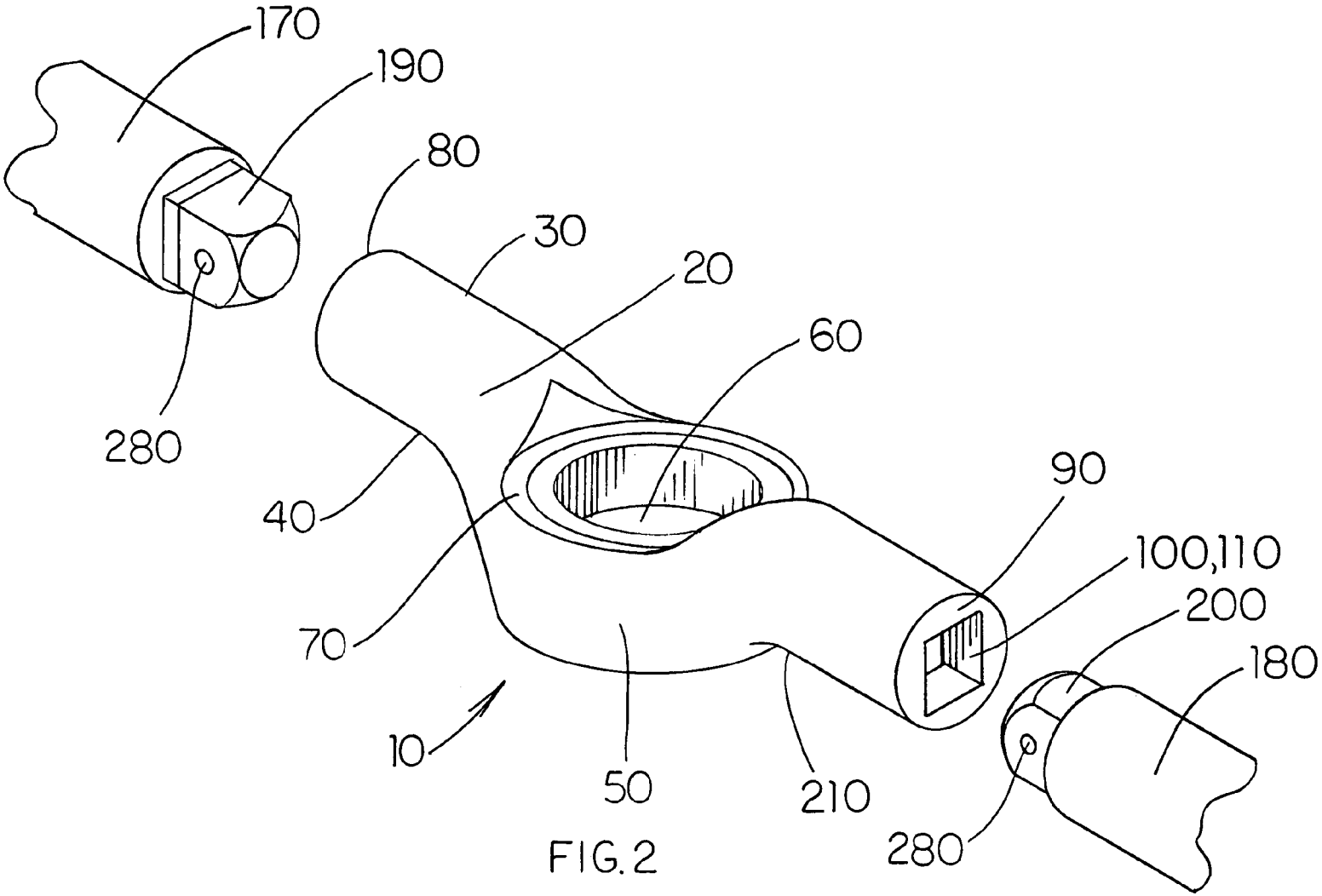
FIG. 2 shows a fragmentary exploded perspective view the elongated ratchet handle without the ratchet mechanism and with the extension arms disengaged from the body.

Turning to FIG. 2, in one version of the invention, the ratchet handle 10 has extension arms 170, 180 releasably connected to the extension arm connectors 100, 110. The extension 170, 180 arms have opposing body connectors 190, 200 configured to be realizably connected with the extension arm connectors 100, 110. In one version, the extension arm connectors 100, 110 comprise bores 220, 230 and the body connectors 190, 200 comprise male sockets 240, 250 configured to be releasably attached within the bores 220, 230.

Figure 3:
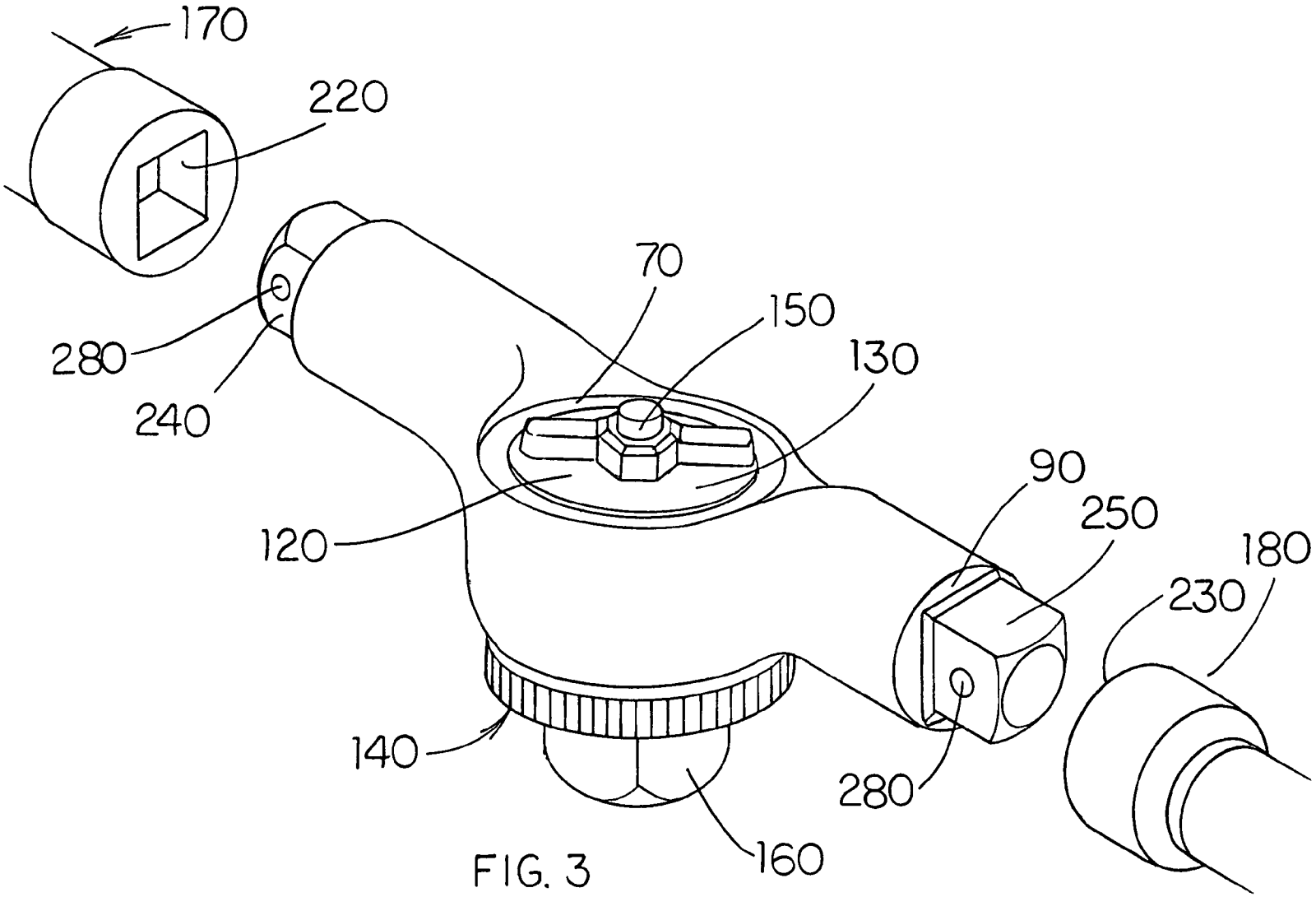
FIG. 3 shows a fragmentary exploded perspective view of the ratchet handle including the ratchet mechanism and the extension arms disengaged from the body.

Referring now to FIG. 3, in another version, the extension arm connectors 190, 200 comprise male sockets 240, 250 and the body connectors 190, 200 comprise bores 220, 230. The male sockets 240, 250 are configured to be releasably attached within the bores 220, 230. In another version, the extension arm connectors 100, 110 and body connectors 190, 200 each have a release mechanism 260, 270 for releasably securing the extension arms 170, 180 to the opposite ends 80, 90.

In one version, the release mechanisms 260, 270 comprise spring-loaded release assemblies. In another version, the release mechanisms 260, 270 comprise ball 280 and detent 290 mechanisms. As is known in the art, the ball 280 will be depressably secured within the male sockets 240, 250 or the body connectors 190, 200 so that the ball 280 engages the detent 290 (FIGS. 6–9) when the extension arms 170, 180 engage the opposite ends 80, 90. The extension arm connectors 100, 110 may have detents 290 configured on an inside surface 320 of the bores 220, 230 to receive the ball 280 of the body connectors 190, 200. In yet another version, the release mechanisms 260, 270 comprise a push button release assembly. It will be apparent to one skilled in the art that many variations of the release mechanisms 260, 270 can be used without departing the scope of the written description, the drawings or the claims.

Figure 5:
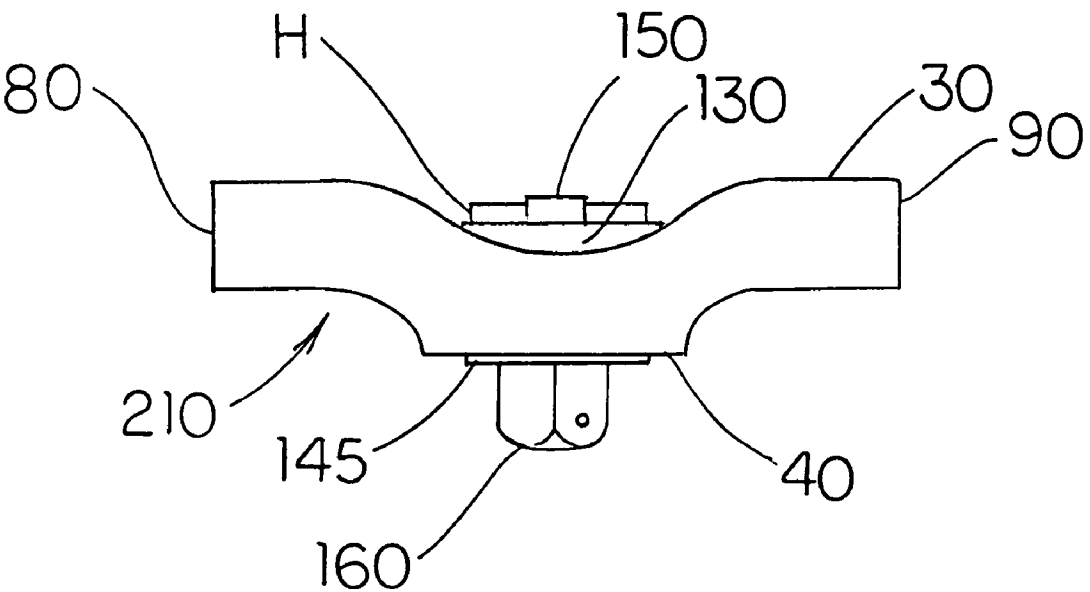
FIG. 5 shows a side view of the ratchet handle.
Figure 4:
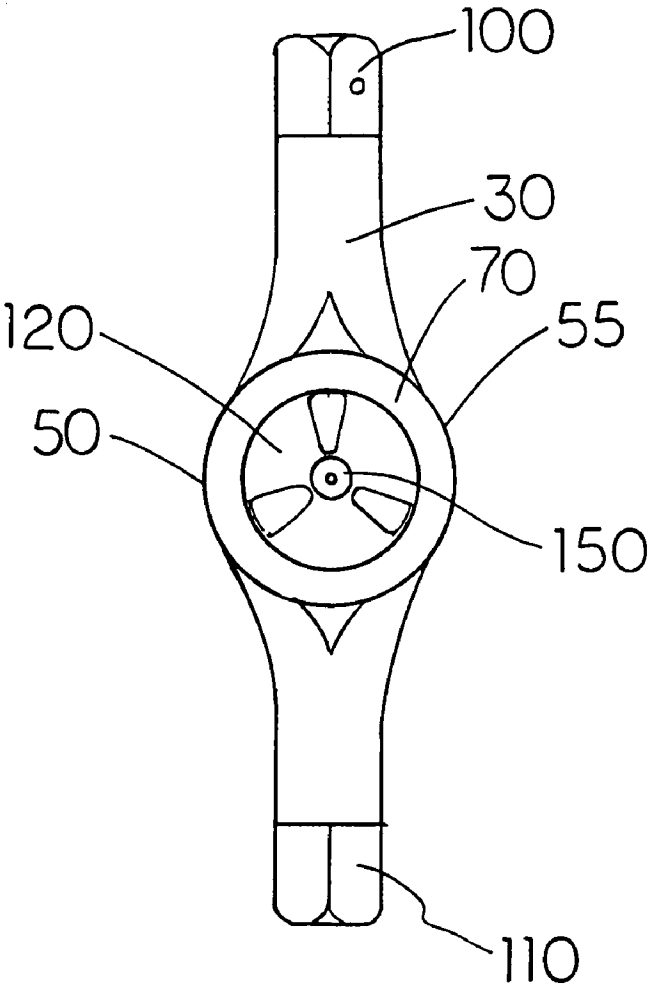
FIG. 4 shows a top view of the ratchet handle.

Referring now to FIGS. 4 and 5, in one version, the elongate body 20 will be at least approximately 4 inches in length from opposite end 80 to opposite end 90, at least about 1 11/16 inches in height measured from the bottom of the drive post 160 to the top 30 of the elongate body 20, and at least about 1¼ inches in width measured at a point half way between opposite end 80 and opposite end 90 from side 50 to side 55 through the center of the ratchet mechanism 120. The opposite ends 80, 90 have cross sections measuring at least about ⅝ inch. The distance "H" from the annular step 70 to the top 30 is at least about 7/16 inch. The diameter of the step diametered bore 60 is about ¾ inches. The ratchet disclosed herein may be manufactured to any size or specification without deviating from the scope of the written description and the claims.

Figure 7:
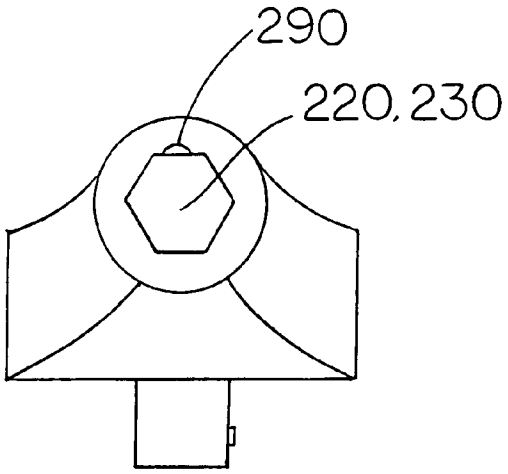
FIG. 7 shows an end view of one version of the ratchet handle having a generally hexagonal bore.
Figure 9:
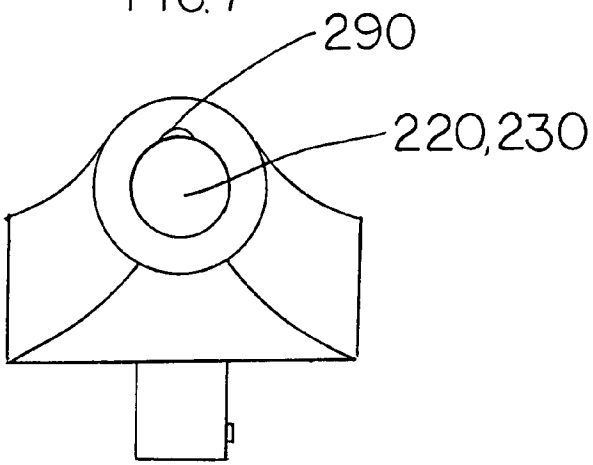
FIG. 9 shows an end view of one version of the ratchet handle having a generally circular bore.
Figure 6:
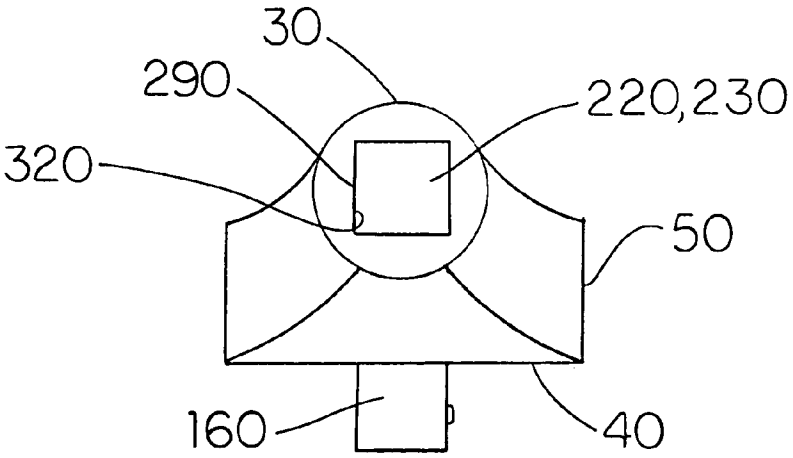
FIG. 6 shows an end view of one version of the ratchet handle having a generally square bore.
Figure 8:
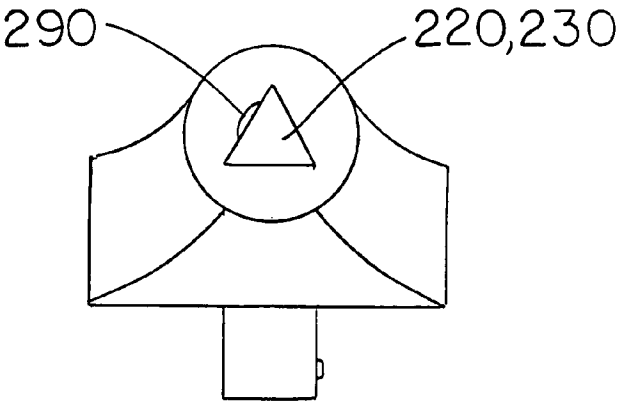
FIG. 8 shows an end view of one version of the ratchet handle having a generally triangular bore.
Figure 10:
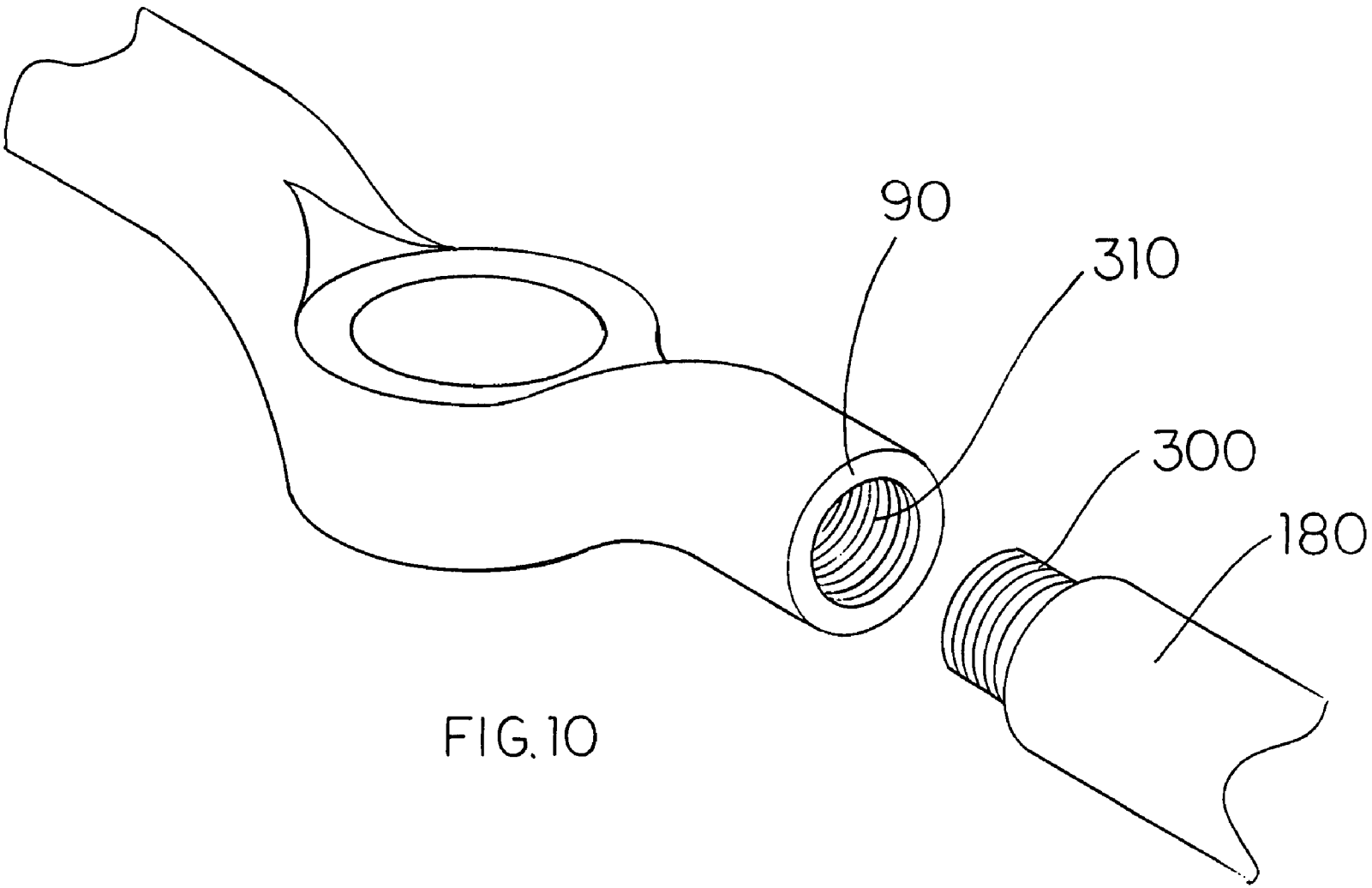
FIG. 10 shows a fragmentary exploded perspective view of one version of the ratchet handle having a female threaded end and an extension handle having a male threaded end.

As shown in FIGS. 6, 7 and 8, the extension arm connectors 100, 110 and body connectors 190, 200 have generally polygonal cross sections. As shown in FIGS. 1–3 and 6, in yet another version, the extension arm connectors 100, 110 and body connectors 190, 200 have generally square cross sections. FIG. 7 shows another version of the body connectors 190, 200 having a hexagonal cross section. FIG. 8 shows yet another version of the body connectors 190, 200 having a triangular cross section. As shown in FIGS. 9 and 10, in one version, the extension arm connectors 110, 120 and body connectors 190, 200 have generally circular cross sections.

Referring to FIG. 10, in other versions of the invention, the extension arm connectors 100, 110 have female threaded ends 310 and the body connectors 190, 200 of the extension arms 170, 180 have male threaded ends 300. The male threaded ends 300 are configured to be releasably screwed into the female threaded ends 310. In another version of the disclosed inventions, the threaded end configuration could be reversed so that the extension arm connectors 100, 110 have male threaded ends 300 and the body connectors 190, 200 have female threaded ends 300. The threaded end configuration allows the extension arms 170, 180 to be secured to the elongated body 20 by screwing the extension arms 170, 180 onto or into the opposite ends 80, 90.

The ratchet handle 10 may be formed of a variety of materials. In one version, the elongated body 20, opposite ends 80, 90 and extension arms 170, 180 can be a metal, a plastic, or any composite of said materials. In versions in which metals are used, the elongated body 20, including the opposite ends 80, 90 and the extension arms 170, 180 may be forged or cast. In one such version, the body 20 and extension arms 170, 180 are drop-forge cast. In yet another embodiment, the body 20 and extension arms 170, 180 are cast molded. In the versions of the disclosed invention in which a plastic is used, any process known in the art for forming plastic can be used, such as and without limitation injection or extrusion molding.

In one version of the disclosed invention, the ratchet mechanism 120 is machined or cast with a flare portion 145 around the bottom surface 140; the flare portion 145 has a diameter slightly bigger then the diameter of the internal gear housed in the ratchet mechanism 120. The top surface 130 of the ratchet mechanism 120 has a slightly larger diameter then the annular step 70 so that when the ratchet mechanism 120 is assembled, the ratchet mechanism 120 is secured within the step diametered bore 60. The ratchet mechanism 120 may be secured in place by a variety of fastening means, including without linitation, interlocking gear members, screws, pins, snap rings, ring bushings, welds, or bolts.

In one version of the invention, by separating the top surface 130 from the ratchet mechanism 120, the ratchet mechanism 120 may be inserted into the step diametered bore 60 from the bottom 40. The top surface 130 is then reattached from the top 30. In another version, the bottom flare portion 145 may be removed from the ratchet mechanism 120; the ratchet mechanism 120 is then inserted into the step diametered bore 60 from the top 30. Once the ratchet mechanism 120 is in its desired location, the bottom flare portion 145 is reattached to the ratchet mechanism 120.

In another version, the ratchet mechanism 120 is generally countersunk into the body 20 a depth greater than a height of the actuator 150 measured transverse of the body 20 so that when the body 20 is gripped in a palm of a hand the actuator 150 is not unintentionally actuated. The body 20 can be formed to accept ratchet mechanisms of various sizes, such as and without limitation, ¼, inch, ⅜ inch, ½ inch and ¾ inch drives.

Specific versions of the disclosed invention have been shown and described for the purpose of illustration. But, the protection offered by any patent which may issue upon this application is not limited to the disclosed versions. Rather, the protection extends to all structures, arrangements and processes falling fairly within the scope of the claims appended hereto and such departures from the present disclosures as become known in the art to which this invention pertains.

What is claimed is:

1. An elongated ratchet handle comprising:

a. an elongated body having a top, a bottom, a side, a centrally located step diametered bore extending from the top through the bottom of said body and an annular step facing said top and surrounding the step diametered bore;

b. said body having opposite ends, each of said ends having extension arm connectors extending axially of said body;

c. a ratchet mechanism having a top surface and a bottom surface, said ratchet mechanism being secured in the step diametered bore, said ratchet mechanism having an actuator being movably positioned on said ratchet mechanism top surface and a drive post depending from said ratchet mechanism bottom surface; and d. said step being spaced from said top of said body.

2. The ratchet handle of claim 1 further comprising an elongated extension arm having opposite ends releasably connected to said extension arm connectors at one of said ends, said extension arm having an opposing body connector at said one end configured for releasable connection with one of said extension arm connectors.

3. The ratchet handle of claim 1, wherein said opposite body ends extend upwardly and outwardly away from said bore thereby defining a finger space between said elongated body and a work piece.

4. The ratchet handle of claim 2, wherein said extension arm connectors comprise bores and said body connectors comprise male sockets configured to be releasably attached within said bores of said extension arm connectors.

5. The ratchet handle of claim 2, wherein said extension arm connectors and body connectors have generally circular cross sections.

6. The ratchet handle of claim 2, wherein said extension arm connectors and body connectors have generally polygonal cross sections.

7. The ratchet handle of claim 6, wherein said extension arm connectors and body connectors have generally square cross sections.

8. The ratchet handle of claim 2, wherein said extension arm connectors comprise male sockets and said body connectors comprise bores, said male sockets of said extension arm connectors being configured to be releasably attached within said bores.

9. The ratchet handle of claim 2, wherein said extension arm connectors and body connectors each have a release mechanism for releasably securing the extension arms to said opposite ends of said body.

10. The ratchet handle of claim 9, wherein said release mechanisms comprise spring-loaded release assemblies.

11. The ratchet handle of claim 9, wherein said release mechanisms comprise detent mechanisms.

12. The ratchet handle of claim 9, wherein said release mechanisms comprise push button release assemblies.

13. The ratchet handle of claim 2, wherein said extension arm connectors have male threaded ends and said body connectors of said extension arms have female threaded ends, said male threaded ends being configured to be releasably threaded into said female threaded ends of the extension arms.

14. The ratchet handle of claim 2, wherein said extension arm connectors have female threaded ends and said body connectors of said extension arms have male threaded ends, said male threaded ends being configured to be releasably threaded into said female threaded ends of the opposing arms.

15. The ratchet handle of claim 1, wherein said ratchet mechanism is generally countersunk into said body a depth greater than a height of the actuator measured transversely of said body so that when the body is gripped in a palm of a hand said actuator is not unintentionally actuated.

16. The ratchet handle of claim 1, wherein said elongated body is formed from a material selected from the group consisting of metals, plastics, or any composite thereof.

17. The ratchet handle of claim 1, wherein said opposite ends of said body are formed from a material selected from the group consisting of metals, plastics, and composites thereof.

18. The ratchet handle of claim 1, wherein said extension arm connectors are formed from a material selected from the group consisting of metals, plastics, and composites thereof.

19. The ratchet handle of claim 2, wherein said extension arms are formed from a material selected from the group consisting of metals, plastics, and composites thereof.

20. The ratchet handle of claim 2, wherein said body connectors are formed from a material selected from the group consisting of metals, plastics, and composites thereof.

21. An elongated ratchet handle comprising:

a. an elongated body having a top, a bottom, a side, a centrally located step diametered bore extending from the top through the bottom and an annular step facing said top and surrounding the step diametered bore;

b. said body having opposite ends, each of said ends extending upwardly and outwardly away from the step diametered bore thereby defining a finger space between the elongated body and a work piece, each of said opposite ends having extension arm connectors extending axially of said body;

c. elongated extension arms having opposite ends releasably connected to said extension arm connectors at one of said ends, each of said extension arms having an opposing body connector at said one end configured for releasable connection with one of said extension arm connectors;

d. said extension arm connectors comprising bores and said body connectors comprising male sockets configured to be releasably attached within said bores, said extension arm connectors and said body connectors each having a release mechanism for releasably securing said extension arms to the opposite ends, the release mechanisms comprising a detent mechanism;

e. a ratchet mechanism having a top surface and a bottom surface, said ratchet mechanism being secured in the step diametered bore and having an actuator being movably positioned on the top surface and a drive post depending from the bottom surface; and f. said step diametered bore being spaced from said top of said body.

22. An elongated body having a centrally located opening therein and opposite ends, a ratchet mechanism in said opening, said ratchet mechanism having a top and a bottom, a drive post extending from the bottom of said ratchet mechanism, said body having means for functionally gripping said body to apply force moments to both said opposite ends and to operate said ratchet mechanism in close quarters, and means at each of said body ends for extending the length of said body for enlarging the force moments that can be applied to said ratchet mechanism.

* * * * *